US010208664B2

(12) United States Patent
Armit et al.

(10) Patent No.: US 10,208,664 B2
(45) Date of Patent: Feb. 19, 2019

(54) COMBUSTION EQUIPMENT

(71) Applicant: ROLLS-ROYCE plc, London (GB)

(72) Inventors: Christopher Armit, Derby (GB); Emmanuel Aurifeille, Derby (GB); Shahrokh Shahpar, Derby (GB); Paul Denman, Loughborough (GB); Christopher Ford, Dulverton (GB)

(73) Assignee: ROLLS-ROYCE plc, London (GB)

( * ) Notice: Subject to any disclaimer, the term of this patent is extended or adjusted under 35 U.S.C. 154(b) by 270 days.

(21) Appl. No.: 15/061,150

(22) Filed: Mar. 4, 2016

(65) Prior Publication Data

US 2016/0290225 A1 Oct. 6, 2016

(30) Foreign Application Priority Data

Mar. 31, 2015 (GB) ..... 1505502.3

(51) Int. Cl.
*F23R 3/10* (2006.01)
*F23R 3/04* (2006.01)
(Continued)

(52) U.S. Cl.
CPC ..... *F02C 3/04* (2013.01); *F23R 3/002* (2013.01); *F23R 3/10* (2013.01); *F23R 3/26* (2013.01)

(58) Field of Classification Search
CPC .... F02C 3/04; F23R 3/002; F23R 3/10; F23R 3/26
(Continued)

(56) References Cited

U.S. PATENT DOCUMENTS 2,720,080 A * 10/1955 Oulianoff ..... F23R 3/60 60/751
3,394,543 A * 7/1968 Slattery ..... F01D 9/065 60/727
(Continued)

FOREIGN PATENT DOCUMENTS

GB 911160 * 11/1962
GB 2120325 A 11/1983
GB 2391297 A 2/2004

OTHER PUBLICATIONS

Aug. 17, 2016 Search Report issued in European Patent Application No. 16 15 8260.
(Continued)

*Primary Examiner* — Ted Kim
(74) *Attorney, Agent, or Firm* — Oliff PLC

(57) ABSTRACT

Combustion equipment includes annular combustion chamber having an annular upstream wall structure. Annular outer casing surrounds and is spaced from annular combustion chamber and annular inner casing is within and spaced from annular combustion chamber. Ogee shaped annular cowl is positioned upstream of annular upstream wall structure and a stage of compressor outlet guide vanes is positioned upstream of annular cowl. Pre-diffuser extends in downstream direction from stage of compressor outlet guide vanes, pre-diffuser is positioned upstream of cowl. Stage of compressor outlet guide vanes is connected to outer and inner casing. Outer fairing extends radially inwardly from outer casing such that annular outer casing, outer fairing and pre-diffuser define annular outer cavity and outer fairing is spaced from cowl or inner fairing extends radially outwardly from inner casing such that annular inner casing, inner fairing and pre-diffuser define an annular inner cavity and inner fairing is spaced from cowl.

11 Claims, 4 Drawing Sheets

(51) Int. Cl.
*F02C 3/04* (2006.01)
*F23R 3/26* (2006.01)
*F23R 3/00* (2006.01)

(58) Field of Classification Search
USPC ..... 60/781
See application file for complete search history.

(56) References Cited

U.S. PATENT DOCUMENTS

| | | | | |
|---|---|---|---|---|
| 3,608,310 | A | 9/1971 | Vaught | |
| 4,458,479 | A * | 7/1984 | Reider | F23R 3/02 60/751 |
| 4,796,429 | A | 1/1989 | Verdouw | |
| 4,852,355 | A * | 8/1989 | Kenworthy | F02C 7/18 60/751 |
| 4,979,361 | A | 12/1990 | Clark et al. | |
| 6,082,966 | A | 7/2000 | Hall et al. | |
| 6,272,865 | B1 | 8/2001 | Clark et al. | |
| 2009/0293487 | A1 | 12/2009 | De Sousa et al. | |

OTHER PUBLICATIONS

Sep. 21, 2015 Search Report issued in British Patent Application No. 1505502.3.

* cited by examiner

COMBUSTION EQUIPMENT

The present disclosure concerns combustion equipment and in particular gas turbine engine combustion equipment.

Gas turbine engine combustion equipment comprises a combustion chamber which has an upstream wall structure and a casing which surrounds and is spaced from the combustion chamber. A cowl is positioned upstream of the upstream wall structure, a stage of compressor outlet guide vanes is positioned upstream of the cowl and the stage of compressor outlet guide vanes is connected to the casing. A pre-diffuser extends in a downstream direction from the stage of compressor outlet guide vanes, the pre-diffuser is positioned upstream of the cowl and a dump region is provided between the pre-diffuser and the cowl.

In operation the pre-diffuser and the dump region decelerate the flow of air to the combustion chamber. The pre-diffuser decelerates the high pressure air exiting the compressor to minimise overall system total pressure loss and isolates the gas turbine engine components upstream from the pre-diffuser from any unsteadiness of the combustion process in the combustion chamber by fixing flow separation at the exit plane of the pre-diffuser.

The shapes of the pre-diffuser, the dump region and the cowl all contribute to the pressure drop within the combustion equipment. The current design of the pre-diffuser, the dump region and the cowl suffers from additional parasitic losses caused by high rates of air flow turning and increased levels of turbulent shear stress generated between the pre-diffuser exit plane and the combustion chamber feed annuli.

According to a first aspect of the disclosure there is provided combustion equipment comprising an annular combustion chamber having an annular upstream wall structure, an annular outer casing surrounding and spaced from the annular combustion chamber, an annular inner casing within and spaced from the annular combustion chamber, an annular cowl being positioned upstream of the annular upstream wall structure, the annular cowl having an upstream end and a downstream end, a stage of compressor outlet guide vanes positioned upstream of the cowl, a pre-diffuser extending in a downstream direction from the stage of compressor outlet guide vanes, the pre-diffuser being positioned upstream of the annular cowl, the stage of compressor outlet guide vanes being connected to the outer casing and the inner casing, an outer fairing extending radially inwardly from the outer casing such that the annular outer casing, the outer fairing and the pre-diffuser define an annular outer cavity and the outer fairing being spaced from the cowl or an inner fairing extending radially outwardly from the inner casing such that the annular inner casing, the inner fairing and the pre-diffuser define an annular inner cavity and the inner fairing being spaced from the cowl.

The outer fairing may extend radially inwardly from the outer casing such that the annular outer casing, the outer fairing and the pre-diffuser define an annular outer cavity and the inner fairing extending radially outwardly from the inner casing such that the annular inner casing, the inner fairing and the pre-diffuser define an annular inner cavity.

The outer fairing may comprise a first portion extending from the outer casing from a position at or downstream of the downstream end of the cowl radially inwardly and in an upstream direction to a position upstream of the downstream end of the cowl and a second portion extending from the first portion radially outwardly to the outer casing.

The first portion of the outer fairing may extend to a position at or downstream of the upstream end of the cowl.

The first portion of the outer fairing may extend to a position upstream of the downstream end of the cowl.

The first portion of the outer fairing may be straight or arcuate.

The first and the second portions of the outer fairing and the outer casing may form a triangle.

The annular outer cavity may be defined by the pre-diffuser, the outer casing, the second portion of the outer fairing and an annular wall extending from the outer casing to the stage of compressor outlet guide vanes.

The second portion of the outer fairing may be positioned downstream of the downstream end of the pre-diffuser.

The outer fairing may comprise a first portion extending from the outer casing from a position at or downstream of the downstream end of the cowl radially inwardly and in an upstream direction to a position upstream of the downstream end of the cowl, a second portion extending from the first portion and a third portion extending from the second portion radially outwardly to the outer casing.

The first, the second and the third portions of the outer fairing and the outer casing may form a parallelogram.

The inner fairing may comprise a first portion extending from the inner casing from a position at or downstream of the downstream end of the cowl radially outwardly and in an upstream direction to a position upstream of the downstream end of the cowl and a second portion extending from the first portion to the inner casing.

The first portion of the inner fairing may extend to a position downstream of the upstream end of the cowl.

The first portion of the inner fairing may extend to a position upstream of the downstream end of the cowl.

The first portion of the inner fairing may be straight or arcuate.

The first and second portions of the inner fairing and the inner casing may form a triangle.

The annular inner cavity may be defined by the pre-diffuser, the inner casing and the second portion of the inner fairing.

The second portion of the inner fairing may be positioned downstream of the downstream end of the pre-diffuser.

The inner fairing may comprise a first portion extending from the inner casing from a position at or downstream of the downstream end of the cowl radially inwardly and in an upstream direction to a position upstream of the downstream end of the cowl, a second portion extending from the first portion and a third portion extending from the second portion radially outwardly to the outer casing.

The first, the second and the third portions of the inner fairing and the inner casing may form a parallelogram.

The annular cowl may be ogee in cross-sectional profile and the apex of the cowl being arranged at the upstream end of the cowl.

The apex of the cowl may be arcuate.

The pre-diffuser may comprise an inner annular wall and an outer annular wall defining an annular passage, the inner annular wall and the outer annular wall being arcuate in cross-section such that the annular passage having a greater cross-sectional area at its downstream end than its upstream end.

The inner annular wall and the outer annular wall may comprise polynomial curves. The polynomial curves may be cubic curves.

An inlet to the annular outer cavity may be defined between the downstream end of the pre-diffuser and the junction between the first and second portions of the outer fairing and an inlet to the annular inner cavity being defined between the downstream end of the pre-diffuser and the junction between the first and second portions of the inner fairing.

The present disclosure also provides combustion equipment comprising an annular combustion chamber having an annular upstream wall structure, an annular outer casing surrounding and spaced from the annular combustion chamber, an annular inner casing within and spaced from the annular combustion chamber, an annular cowl being positioned upstream of the annular upstream wall structure, the annular cowl having an upstream end and a downstream end, a stage of compressor outlet guide vanes positioned upstream of the annular cowl, a pre-diffuser extending in a downstream direction from the stage of compressor outlet guide vanes, the pre-diffuser being positioned upstream of the cowl, the stage of compressor outlet guide vanes being connected to the outer casing and the inner casing, an outer fairing extending radially inwardly from the outer casing such that the annular outer casing, the outer fairing and the pre-diffuser define an annular outer cavity and the outer fairing being spaced from the cowl, the outer fairing comprising a first portion extending from the outer casing radially inwardly and in an upstream direction to a position upstream of the downstream end of the cowl and a second portion extending from the first portion radially outwardly to the outer casing, the first portion of the outer fairing extending to a position at or downstream of the upstream end of the cowl, an inner fairing extending radially outwardly from the inner casing such that the annular inner casing, the inner fairing and the pre-diffuser define an annular inner cavity and the inner fairing being spaced from the cowl, the inner fairing comprising a first portion extending from the inner casing radially outwardly and in an upstream direction to a position upstream of the downstream end of the cowl and a second portion extending from the first portion to the inner casing, the first portion of the inner fairing extending to a position downstream of the upstream end of the cowl, and the annular cowl being ogee in cross-sectional profile and the apex of the cowl being arranged at the upstream end of the cowl.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
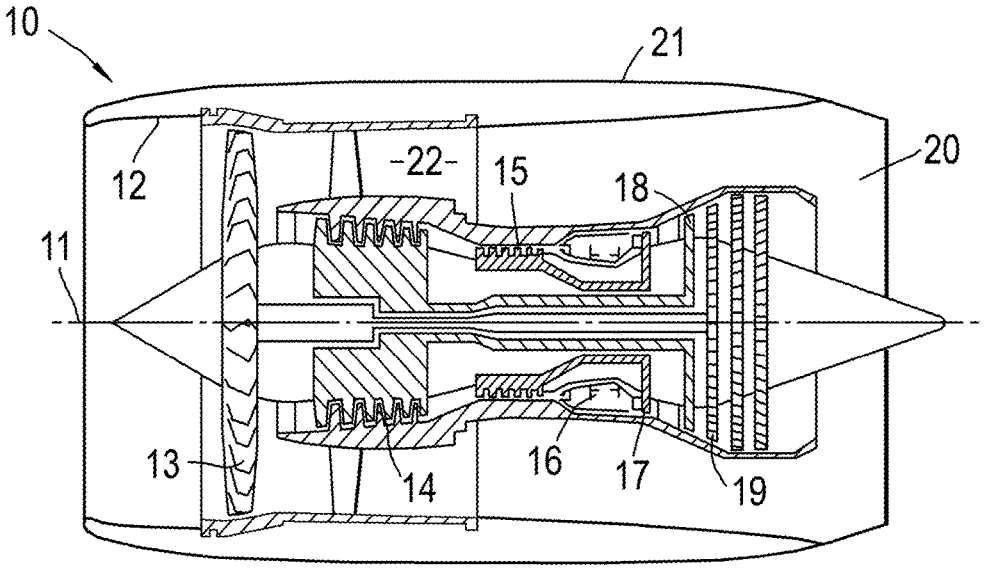
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Figure 2:
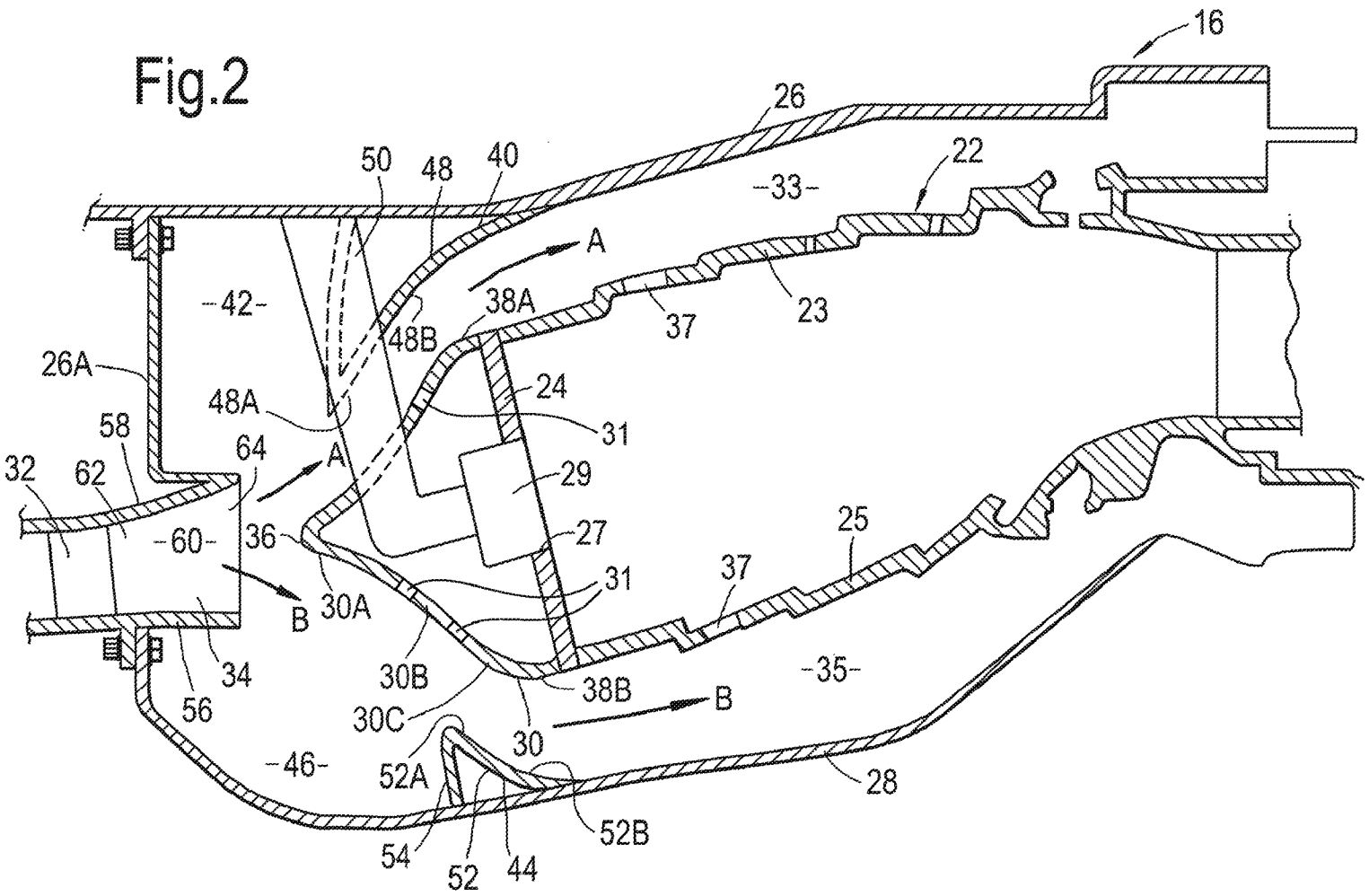
FIG. 2 is an enlarged cross-sectional view through the combustion equipment shown in FIG. 1.

The combustion equipment 16, as shown more clearly in FIG. 2, includes an annular combustion chamber 22 which comprises a radially outer annular wall structure 23, an annular upstream wall structure 24 and a radially inner annular wall structure 25. The upstream end of the radially outer annular wall structure 23 and the upstream end of the radially inner annular wall structure 25 are secured to the annular upstream wall structure 24. The combustion equipment 16 further includes an annular outer casing 26 which surrounds and is spaced from the annular combustion chamber 22 and an annular inner casing 28 which is arranged within and is spaced from the annular combustion chamber 22. The annular outer casing 26 is arranged radially around and is spaced radially from the radially outer annular wall structure 23 of the annular combustion chamber 22 and the annular inner casing 28 is arranged radially within and is spaced radially from the radially inner annular wall structure 25 of the annular combustion chamber 22.

The combustion equipment 16 additionally includes an annular cowl 30 positioned upstream of the annular upstream wall structure 24, a stage of compressor outlet guide vanes 32 positioned upstream of the annular cowl 30 and a pre-diffuser 34 which extends in a downstream direction from the stage of compressor outlet guide vanes 32. The pre-diffuser 34 is positioned upstream of the annular cowl 30. The stage of compressor outlet guide vanes 32 is connected to the annular outer casing 26 and the annular inner casing 28. The stage of compressor outlet guide vanes 32 is directly connected to the annular inner casing 28 but is indirectly connected to the annular outer casing 26 by an annular wall 26A. The annular cowl 30 has an upstream end 36 and radially inner and radially outer downstream ends 38A and 38B respectively and the annular cowl 30 is ogee in cross-sectional profile and the apex of the annular cowl 30 is arranged at the upstream end 36 of the annular cowl 30 and the downstream ends 38A and 38B of the annular cowl 30 are secured to the annular upstream wall structure 24 of the annular combustion chamber 22. The annular cowl 30 thus comprises two elongated S shapes in cross-sectional profile, each of which comprises a convex region 30A, a concave region 30B and a convex region 30C in series between the upstream end 36 and the downstream end 38 of the ogee shaped annular cowl 30. The apex at the upstream end 36 of the annular cowl 30 is arcuate. The annular cowl 30 may comprise two elongated S shapes in cross-sectional profile, each of which comprises a convex region 30A, a convex region 30B and a convex region 30C in series between the upstream end 36 and the downstream end 38 of the ogee shaped annular cowl 30 and in which the convex region 30A and the convex region 30C have greater curvature than the convex region 30B. The annular cowl 30 may comprise two elongated S shapes in cross-sectional profile, each of which comprises a convex region 30A, a straight region 30B and a convex region 30C in series between the upstream end 36 and the downstream end 38 of the ogee shaped annular cowl 30. The annular cowl 30 may be axisymmetric or non-axisymmetric with respect to the axis 11 of the gas turbine engine 10. The apex of the annular cowl 30 may be arranged at any radial position with respect to the centre line of the pre-diffuser 34 in accordance with the downstream flow split requirements.

An outer flow annulus 33 is defined between the annular outer casing 26 and the radially outer annular wall structure 23 of the combustion chamber 22 and an inner flow annulus 35 is defined between the annular inner casing 28 and the radially inner annular wall structure 25 of the combustion chamber 22. The outer flow annulus 33 and the inner flow annulus supply air for cooling the radially outer annular wall structure 23 and the radially inner annular wall structure 25 and also supply dilution air through dilution apertures 37 into the annular combustion chamber 22.

The annular upstream wall structure 24 has a plurality of circumferentially spaced apertures 27 and the upstream end 36 of the annular cowl 30 has a plurality of circumferentially spaced apertures 31 and the apertures 31 in the annular cowl 30 are aligned with the apertures 27 in the annular upstream wall structure 24. The combustion equipment 16 also comprises a plurality of fuel injector nozzles 29 and each fuel injector nozzle 29 extends through a respective one of the apertures 31 in the annular cowl 30 and locates in a respective one of the apertures 27 in the annular upstream wall structure 24. The apertures 31 in the annular cowl 30 are plunged to deliver air to the fuel injector nozzles 29 and to the annular upstream wall structure 42 to provide impingement and/or effusion cooling of the annular upstream wall structure 42. The fuel injector nozzles 29 are supplied with fuel and the fuel injector nozzles 29 atomise the fuel with the air and supply the fuel and air into the annular combustion chamber 22.

The combustion equipment 16 also includes an outer fairing 40 and an inner fairing 44. The outer fairing 40 extends radially inwardly from the annular outer casing 26 such that the annular outer casing 26, the annular wall 26A, the outer fairing 40 and the pre-diffuser 34 define an annular outer cavity 42 and the outer fairing 40 is spaced radially from the annular cowl 30. The inner fairing 44 extends radially outwardly from the annular inner casing 28 such that the annular inner casing 28, the inner fairing 44 and the pre-diffuser 34 define an annular inner cavity 46 and the inner fairing 44 is spaced radially from the annular cowl 30. The outer fairing 40 and the inner faring 44 may be axisymmetric or non-axisymmetric with respect to the axis of the gas turbine engine 10.

The outer fairing 40 comprises a first portion 48 extending from the annular outer casing 26 from a position at or downstream of the upstream wall structure 24 radially inwardly and in an upstream direction and a second portion 50 extending from the first portion 48 radially outwardly to the annular outer casing 26. The first portion 48 of the outer fairing 40 extends at least to a position upstream of the annular upstream wall structure 24. The first portion 48 of the outer fairing 40 extends to a position at or downstream of the apex at the upstream end 36 of the annular cowl 30. The first and second portions 48 and 50 of the outer fairing 40 and the annular outer casing 26 generally form a triangle. The first portion 48 of the outer fairing 40 is arcuate and the second portion 50 of the outer fairing 40 is straight. The second portion 50 of the outer fairing 40 may be arcuate. The junction between the first portion 48 and the second portion 50 of the outer fairing 40 may be arcuate or a vertex. Alternatively, it is seen that the first portion 48 extends from the annular outer casing 26 from a position at or downstream of the downstream end 38A of the annular cowl 30 radially inwardly and in an upstream direction to a position upstream of the downstream end 38A of the annular cowl 30 and the second portion 50 extends from the first portion 48 radially outwardly to the annular outer casing 26.

The inner fairing 44 comprises a first portion 52 extending from the annular inner casing 28 from a position at or downstream of the upstream wall structure 24 radially outwardly and in an upstream direction and a second portion 54 extending from the first portion 52 radially inwardly to the annular inner casing 28. The first portion 52 of the inner fairing 44 extends at least to a position upstream of the annular upstream wall structure 24. The first portion 52 of the inner fairing 44 extends to a position downstream of the apex at the upstream end 36 of the annular cowl 30. The first and second portions 52 and 54 of the inner fairing 44 and the annular inner casing 28 generally form a triangle. The first portion 52 of the inner fairing 44 is arcuate and the second portion 54 of the inner fairing 44 is straight. The second portion 54 of the inner fairing 44 may be arcuate. The junction between the first portion 52 and the second portion 54 of the inner outer fairing 40 may be arcuate or a vertex. Alternatively, it is seen that the first portion 52 extends from the annular inner casing 28 from a position at or downstream of the downstream end 38B of the annular cowl 30 radially outwardly and in an upstream direction to a position upstream of the downstream end 38B of the annular cowl 30 and the second portion 54 extends from the first portion 52 radially inwardly to the annular inner casing 28.

The first portion 48 of the outer fairing 40 is arcuate and comprises a convex upstream portion 48A and a concave downstream portion 48B. The first portion 52 of the inner fairing 44 is arcuate and comprises a convex upstream portion 52A and a concave downstream portion 52B. The annular cowl 30 is arcuate and each of the elongated S shapes comprises a convex upstream portion 30A, a concave middle portion 30B and a convex downstream portion 30C. The convex upstream portion 48A of the first portion 48 of the outer fairing 40 is arranged radially outwardly of the concave middle portion 30B of the outer elongated S shape of the cowl 30 and the concave downstream portion 48B of the first portion 48 of the outer fairing 40 is arranged radially outwardly of the convex downstream portion 30C of the outer elongated S shape of the cowl 30. The concave downstream portion 52B of the first portion 52 of the inner fairing 44 is arranged radially inwardly of the convex downstream portion 30C of the inner elongated S shape of the cowl 30.

The pre-diffuser 34 comprises an inner annular wall 56 and an outer annular wall 58 which defines an annular passage 60, the inner annular wall 56 and the outer annular wall 58 are shaped, arcuate in cross-section, such that the annular passage 60 has a greater cross-sectional area at its downstream end 64 than its upstream end 62. The inner annular wall 56 and the outer annular wall 58 of the pre-diffuser 34 may comprise polynomial curves, e.g. cubic curves, in cross-section.

The outer fairing 40 may have cut outs to receive the feed arms of the fuel injector nozzles 29. The outer fairing 40 may also have cut outs to receive support pins which extend radially from the annular outer casing 26 to the annular cowl 30 or the annular upstream wall structure 24 to support the annular combustion chamber 22 from the annular outer casing 26.

The annular outer cavity 42 is defined by the pre-diffuser 34, the annular wall 26A, the annular outer casing 26 and the second portion 50 of the outer fairing 40. An inlet to the annular outer cavity 42 is defined between the downstream end 64 of the pre-diffuser 34 and the junction between the first and second portions 48 and 50 respectively of the outer fairing 40. The annular inner cavity 46 is defined by the pre-diffuser 34, the annular inner casing 28 and the second portion 54 of the inner fairing 44. An inlet to the annular inner cavity 46 is defined between the downstream end 64 of the pre-diffuser 34 and the junction between the first and second portions 52 and 54 of the inner fairing 44. The second portion 50 of the outer fairing 40 is downstream of the downstream end 64 of the pre-diffuser 34 and the second portion 54 of the inner fairing 44 is downstream of the downstream end 64 of the pre-diffuser 34. The second portion 50 of the outer fairing 40 is at or downstream of the upstream end 36 of the cowl 30 and the second portion 54 of the inner fairing 44 is downstream of the upstream end 36 of the cowl 30. The first portion 52 of the inner fairing 44 extends to a position radially inwardly of the downstream end 38 of the annular cowl 30.

In operation high pressure air from the high pressure compressor 15 is supplied via the compressor outlet guide vanes 32 and the pre-diffuser 34 over the annular cowl 30 to the outer flow annulus 33 and the inner flow annulus 35, as indicated by arrows A and B. The flows of air A and B from the pre-diffuser 34 to the outer flow annulus 33 and the inner flow annulus 35 respectively are assisted by the shape of the pre-diffuser 34, the shape of the annular cowl 30 and the shapes of the outer and inner fairings 40 and 44. The outer and inner fairings 40 and 44 define the annular outer and inner cavities 42 and 46 and recirculating flows of air are formed, and stabilised, in the annular outer and inner cavities 42 and 46 respectively. The recirculating flows of air in the outer and inner annular cavities 42 and 46 produce low pressure regions which encourage the air flow to turn more gradually into the outer flow annulus 33 and the inner flow annulus 35 respectively reducing the net flow deflection and turbulent shear stress within the air flow entering the outer flow annulus 33 and the inner flow annulus 35. The upstream pressure field generated by the annular cowl 30 enables the inner and outer annular walls 56 and 58 of the pre-diffuser 34 to be shaped to increase the radial flow deflection before the air leaves the pre-diffuser 34. The shapes of the inner and outer annular walls 56 and 58 of the pre-diffuser 34 ensure that the flow separation remains fixed at the exit plane of the pre-diffuser 34 and the component area ratio is increased to reduce the exit flow velocity. The integration of the pre-diffuser 34 with the annular cowl 30 encourages the air flow to turn more gradually into the outer flow annulus 33 and the inner flow annulus 35 respectively reducing the turbulent shear stress within the air flow entering the outer flow annulus 33 and the inner flow annulus 35.

Figure 3:
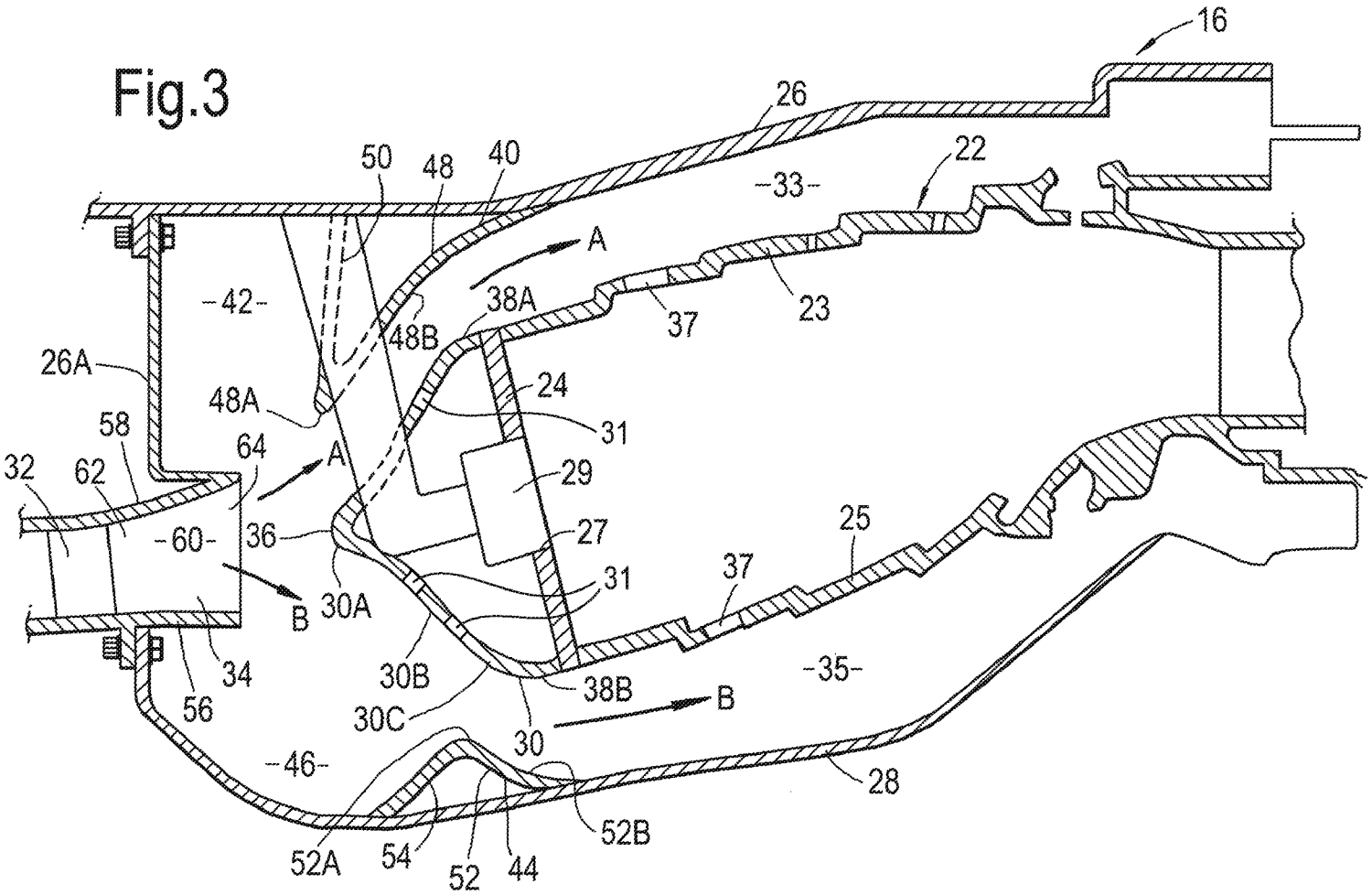
FIG. 3 is an alternative enlarged cross-sectional view through the combustion equipment shown in FIG. 1.

The combustion equipment in FIG. 3 is similar to that in FIG. 2, but in FIG. 3 the first portion 48 of the outer fairing 40 extends to a position upstream of the apex at the upstream end 36 of the annular cowl 30. The second portion 54 of the inner fairing 44 extends to a position on the inner fairing 44 at or just downstream of the apex at the upstream end 36 of the annular cowl 30 and thus a different triangle shape is formed between the first and second portions 52 and 54 of the inner fairing 44 and the inner casing 28. The inner and outer fairings 44 and 40 may be axisymmetric or non-axisymmetric with respect to the axis of the gas turbine engine 10.

The annular outer cavity 42 is defined by the pre-diffuser 34, the annular wall 26A, the annular outer casing 26 and the second portion 50 of the outer fairing 40. An inlet to the annular outer cavity 42 is defined between the downstream end 64 of the pre-diffuser 34 and the junction between the first and second portions 48 and 50 respectively of the outer fairing 40. The annular inner cavity 46 is defined by the pre-diffuser 34, the annular inner casing 28 and the second portion 54 of the inner fairing 44. An inlet to the annular inner cavity 46 is defined between the downstream end 64 of the pre-diffuser 34 and the junction between the first and second portions 52 and 54 of the inner fairing 44. The second portion 50 of the outer fairing 40 is downstream of the downstream end 64 of the pre-diffuser 34 and the second portion 54 of the inner fairing 44 is downstream of the downstream end 64 of the pre-diffuser 34. The second portion 50 of the outer fairing 40 extends from a position upstream of the upstream end 36 of the cowl 30 to a position downstream of the upstream end 36 of the cowl 30 and the second portion 54 of the inner fairing 44 is at or downstream of the upstream end 36 of the cowl 30. The first portion 52 of the inner fairing 44 extends to a position radially inwardly of the downstream end 38 of the annular cowl 30.

Figure 4:
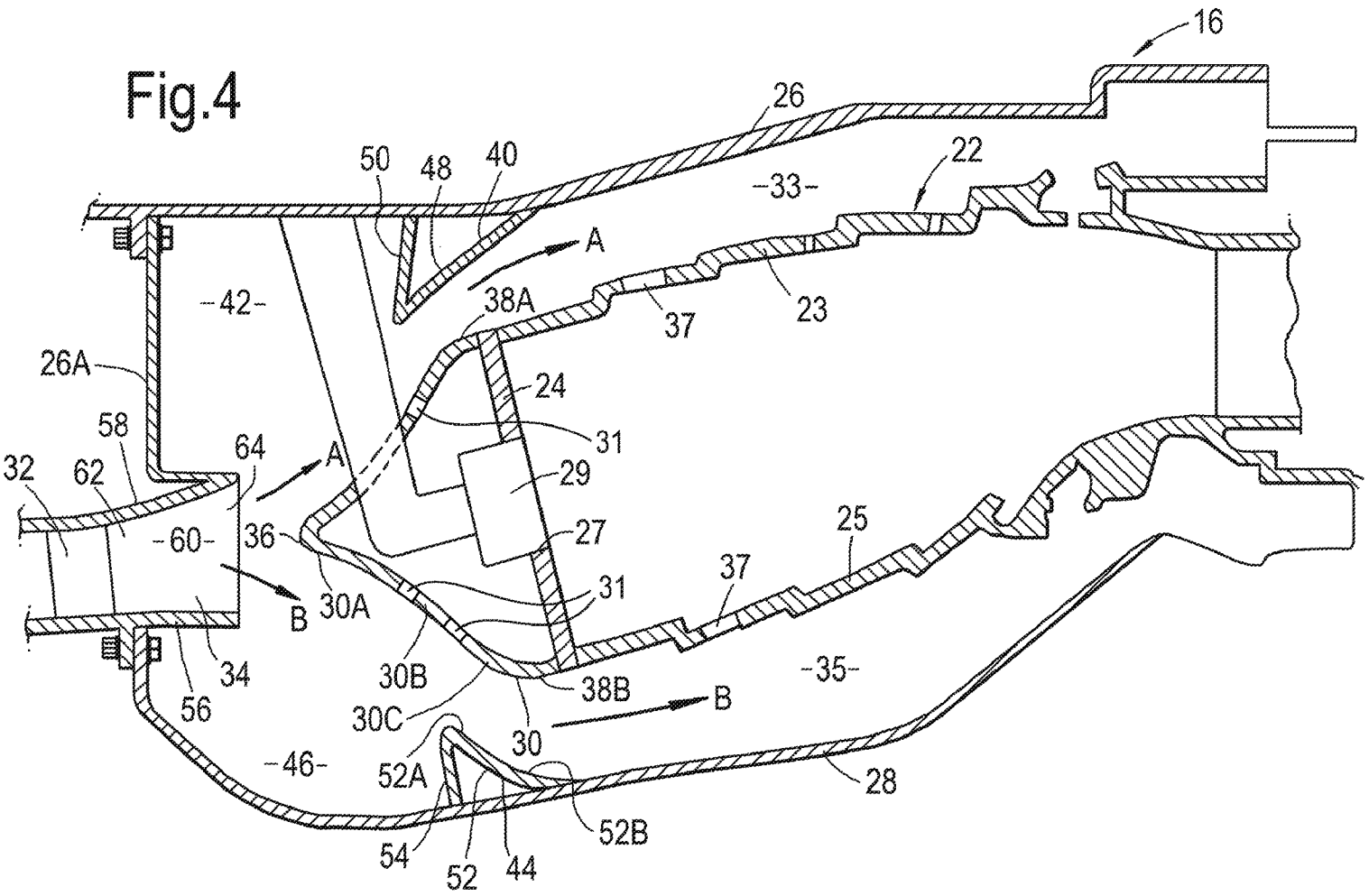
FIG. 4 is an alternative enlarged cross-sectional view through the combustion equipment shown in FIG. 1.

The combustion equipment in FIG. 4 is similar to that in FIG. 2, but in FIG. 4 the first portion 48 of the outer fairing 40 extends to a position upstream of the annular upstream end wall structure 24 and downstream of the apex at the upstream end 36 of the annular cowl 30 and the first portion 52 of the inner fairing 44 extends to a position upstream of the annular upstream end wall structure 24 and downstream of the apex at the upstream end 36 of the annular cowl 30. The first and second portions 48 and 50 of the outer fairing 40 are straight with a curved junction between the first and second portions 48 and 50 of the outer fairing 40. The first and second portions 52 and 54 of the inner fairing 44 are straight with a curved junction between the first and second portions 52 and 54 of the inner fairing 44. The first and the second portion 48 and 50 of the outer fairing 40 and the annular outer casing 26 generally form a triangle. The first and second portions 52 and 54 of the inner fairing 44 and the annular inner casing 28 generally form a triangle. The inner and outer fairings 44 and 40 may be axisymmetric or non-axisymmetric with respect to the axis 11 of the gas turbine engine 10. Alternatively, it is seen that the first portion 48 extends from the annular outer casing 26 from a position at or downstream of the downstream end 38A of the annular cowl 30 radially inwardly and in an upstream direction to a position upstream of the downstream end 38A of the annular cowl 30 and downstream of the apex at the upstream end 36 of the annular cowl 30 and the second portion 50 extends from the first portion 48 radially outwardly to the annular outer casing 26. Alternatively, it is seen that the first portion 52 extends from the annular inner casing 28 from a position at or downstream of the downstream end 38B of the annular cowl 30 radially outwardly and in an upstream direction to a position upstream of the downstream end 38B of the annular cowl 30 and downstream of the apex at the upstream end 36 of the annular cowl 30 and the second portion 54 extends from the first portion 52 radially inwardly to the annular inner casing 28.

The annular outer cavity 42 is defined by the pre-diffuser 34, the annular wall 26A, the annular outer casing 26 and the second portion 50 of the outer fairing 40. An inlet to the annular outer cavity 42 is defined between the downstream end 64 of the pre-diffuser 34 and the junction between the first and second portions 48 and 50 respectively of the outer fairing 40. The annular inner cavity 46 is defined by the pre-diffuser 34, the annular inner casing 28 and the second portion 54 of the inner fairing 44. An inlet to the annular inner cavity 46 is defined between the downstream end 64 of the pre-diffuser 34 and the junction between the first and second portions 52 and 54 of the inner fairing 44. The second portion 50 of the outer fairing 40 is downstream of the downstream end 64 of the pre-diffuser 34 and the second portion 54 of the inner fairing 44 is downstream of the downstream end 64 of the pre-diffuser 34. The second portion 50 of the outer fairing 40 is at or downstream of the upstream end 36 of the cowl 30 and the second portion 54 of the inner fairing 44 is downstream of the upstream end 36 of the cowl 30. The first portion 48 of the outer fairing 40 extends to a position radially outwardly of the downstream end 38 of the annular cowl 30. The first portion 52 of the inner fairing 44 extends to a position radially inwardly of the downstream end 38 of the annular cowl 30.

The present disclosure provides an annular cowl which is ogee in cross-sectional profile. The gradient of the annular cowl gradually increases from its upstream end to a mid-point and then reduces towards the downstream end where the annular cowl meets and is secured to the annular upstream end wall. The apex of the annular cowl is rounded and not sharp edged to allow incidence tolerance which is required through the flight envelope, particularly at off-design conditions and the reduced thickness helps to minimise drag and turn the flow smoothly. The annular cowl characteristics (apex radius, apex radial height, axial length from pre-diffuser, secondary curvatures) all impact the flow characteristics (total pressure loss, static pressure recovery, flow splits and uniformity) within the combustion chamber of the combustion equipment. The annular cowl modifies the pressure gradient in and around the exit plane of the pre-diffuser. The re-shaping of the pressure gradient increases the aerodynamic loading along the centre line of the pre-diffuser whilst reducing adverse pressure imposed upon the boundary layers on the outer and inner casings. The adjustment of the pressure field/pressure gradient presented to the air flow exiting the pre-diffuser serves to enhance the static pressure recovery, thereby reducing the dynamic pressure of the air flow exiting the pre-diffuser and minimising the total pressure loss generated downstream of the pre-diffuser. The pre-diffuser walls provide a greater flow deflection.

The fairings may have any suitable shape and may have straight or rounded surfaces protruding from the annular outer casing and annular inner casing towards the annular combustion chamber and/or annular cowl. The characteristics of the fairings (axial length and depth, radial height, lean angle, radius of curvature) all impact the flow within the outer flow annulus and the inner flow annulus. The range of angles of the first portions of the outer and inner fairings to the outer and inner casings respectively may be between 20° to 90°.The range of angles of the second portions of the outer and inner fairings to the outer and inner casings respectively may be between 45° and 145°. However, in general these surfaces are more likely to be curved to generate stronger recirculating flows within the annular inner and outer cavities bounded by the pre-diffuser walls and the inner and outer fairings. Stronger recirculating flows improve the flow stability within the dump cavity and generate lower static pressure regions to enhance turning of the flow within the combustor annuli. The junctions between the first and the second portions of the outer and inner fairings control the points of re-attachment of the air flow within the outer flow annulus and the inner flow annulus respectively to minimise losses in these annuli.

In addition, the low-pressure regions generated by the captured recirculation zones located within the annular outer and inner cavities in the dump cavity also encourage the annulus stream tubes to turn more gradually into the outer annular flow annulus and the inner annular flow annulus thus reducing the net flow deflection and turbulent shear stress within the flow entering the outer annular flow annulus and the inner annular flow annulus.

The present disclosure increases the aerodynamic efficiency of the pre-diffuser, dump region and cowl of the combustion equipment. The present disclosure may improve the specific fuel consumption.

Although the present disclosure has referred to the use of an outer fairing, an annular outer cavity, an inner fairing and an annular inner cavity it may be possible to provide an outer faring and an annular outer cavity only or an inner fairing and an annual inner cavity only. Although the present invention has referred to the use of a cowl which is ogee in cross-sectional profile a cowl with another suitable cross-sectional profile may be used.

Although the present disclosure has referred to the outer fairing extending radially inwardly from the outer casing from a position at or downstream of the downstream end of the cowl it may be possible for the outer fairing to extend radially inwardly from the outer casing from a position upstream of the downstream end of the cowl. Similarly, although the present disclosure has referred to the inner fairing extending radially inwardly from the inner casing from a position at or downstream of the downstream end of the cowl it may be possible for the inner fairing to extend radially inwardly from the inner casing from a position upstream of the downstream end of the cowl.

Although the present disclosure has been described with reference to a turbofan gas turbine engine it is equally applicable to a turbojet gas turbine engine, a turbo-shaft gas turbine engine or a turbo-propeller gas turbine engine.

Although the present disclosure has been described with reference to a three shaft gas turbine engine it is equally applicable to a two shaft gas turbine engine or a single shaft gas turbine engine.

Although the present disclosure has been described with reference to an aero gas turbine engine it is equally applicable to a marine gas turbine engine, an industrial gas turbine engine or an automotive gas turbine engine and is equally applicable to other types of turbomachine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. Combustion equipment comprising:

an annular combustion chamber that includes an annular upstream wall structure, an annular outer casing surrounding and spaced from the annular combustion chamber, and an annular inner casing within and spaced from the annular combustion chamber, an annular cowl positioned upstream of the annular upstream wall structure, the annular cowl having an upstream end and a downstream end, a stage of compressor outlet guide vanes positioned upstream of the annular cowl, the stage of compressor outlet guide vanes being connected to the outer casing and the inner casing, a pre-diffuser that extends in a downstream direction from the stage of compressor outlet guide vanes, the pre-diffuser being positioned upstream of the cowl, an outer fairing that extends radially inwardly from the outer casing such that the annular outer casing, the outer fairing and the pre-diffuser define an annular outer cavity, the outer fairing being spaced from the cowl, the outer fairing comprising a concave first portion extending from the outer casing radially inwardly and in an upstream direction to a position upstream of the downstream end of the cowl and a second portion extending from the first portion radially outwardly to the outer casing, the first portion of the outer fairing extending to a position at or downstream of the upstream end of the cowl, and an inner fairing that extends radially outwardly from the inner casing such that the annular inner casing, the inner fairing and the pre-diffuser define an annular inner cavity, the inner fairing being spaced from the cowl, the inner fairing comprising a concave first portion extending from the inner casing radially outwardly and in an upstream direction to a position upstream of the downstream end of the cowl and a second portion extending from the first portion to the inner casing, the first portion of the inner fairing extending to a position downstream of the upstream end of the cowl, wherein the annular cowl is ogee in cross-sectional profile and an apex of the cowl is arranged at the upstream end of the cowl.

2. The combustion equipment as claimed in claim 1, wherein the first and the second portions of the outer fairing and the outer casing form a triangle.

3. The combustion equipment as claimed in claim 1, wherein the first and second portions of the inner fairing and the inner casing form a triangle.

4. The combustion equipment as claimed in claim 1, wherein the apex of the cowl is arcuate.

5. The combustion equipment as claimed in claim 1, wherein the pre-diffuser comprises an inner annular wall and an outer annular wall defining an annular passage, the inner annular wall and the outer annular wall being arcuate in cross-section such that the annular passage has a greater cross-sectional area at its downstream end than its upstream end.

6. The combustion equipment as claimed in claim 5, wherein the inner annular wall and the outer annular wall are cubic curves.

7. The combustion equipment as claimed in claim 1, wherein the annular outer cavity is defined by the the second portion of the outer fairing and an annular wall extending from the outer casing to the stage of compressor outlet guide vanes.

8. The combustion equipment as claimed in claim 1, wherein the annular inner cavity is defined by the second portion of the inner fairing.

9. The combustion equipment as claimed in claim 1, wherein the second portion of the outer fairing is positioned downstream of a downstream end of the pre-diffuser.

10. The combustion equipment as claimed in claim 1, wherein the second portion of the inner fairing is positioned downstream of the downstream end of the pre-diffuser.

11. The combustion equipment as claimed in claim 1, wherein:

an inlet to the annular outer cavity is defined between a downstream end of the pre-diffuser and a junction between the first and second portions of the outer fairing, and an inlet to the annular inner cavity is defined between the downstream end of the pre-diffuser and a junction between the first and second portions of the inner fairing.

* * * * *